US008380461B2

(12) United States Patent
Wissmann et al.

(10) Patent No.: US 8,380,461 B2
(45) **Date of Patent: *Feb. 19, 2013**

(54) CONSTRUCTION MODULUS TESTING APPARATUS AND METHOD

(75) Inventors: Kord J. Wissmann, Mooresville, NC (US); John Hildreth, Harrisburg, NC (US); Barry Sherlock, Concord, NC (US)

(73) Assignees: Geopier Foundation Company, Inc., Davidson, NC (US); University of North Carolina at Charlotte, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/439,978

(22) Filed: Apr. 5, 2012

(65) Prior Publication Data

US 2012/0195692 A1 Aug. 2, 2012

Related U.S. Application Data

(63) Continuation of application No. 13/143,429, filed as application No. PCT/US2010/020412 on Jan. 8, 2010, now Pat. No. 8,155,919.

(60) Provisional application No. 61/143,576, filed on Jan. 9, 2009.

(51) Int. Cl.
*G01C 9/00* (2006.01)
*G06F 19/00* (2011.01)

(52) U.S. Cl. ..... 702/150; 405/232; 405/240; 405/271

(58) Field of Classification Search ..... 702/92, 702/94, 95, 104, 105, 150, 174, 176; 405/232, 405/233, 237, 240, 243, 245, 271
See application file for complete search history.

(56) References Cited

U.S. PATENT DOCUMENTS

| | | | | |
|---|---|---|---|---|
| 5,249,892 | A | 10/1993 | Fox et al. | |
| 6,354,766 | B1 | 3/2002 | Fox | |
| 6,425,713 | B2 | 7/2002 | Fox et al. | |
| 7,004,684 | B2 | 2/2006 | Fox | |
| 7,226,246 | B2 | 6/2007 | Fox | |
| 7,326,004 | B2 | 2/2008 | Wissmann et al. | |
| 7,488,139 | B2 * | 2/2009 | Wissmann | 405/271 |

FOREIGN PATENT DOCUMENTS

| | | | |
|---|---|---|---|
| CA | 2641408 | A1 | 4/2009 |
| KR | 20030071288 | A | 9/2003 |

* cited by examiner

*Primary Examiner* — John H Le
(74) *Attorney, Agent, or Firm* — Ward and Smith, P.A.

(57) ABSTRACT

A system and method of determining lift deflection during construction of aggregate columns allows for real time monitoring of construction to ensure meeting defined parameters. The amount of deflection of a tamper head during tamping is determined multiple times for each lift. When the amount of deflection matches a predetermined value, tamping is stopped.

29 Claims, 12 Drawing Sheets

CONSTRUCTION MODULUS TESTING APPARATUS AND METHOD

CROSS REFERENCE TO RELATED APPLICATIONS

This application is continuation application of U.S. patent application Ser. No. 13/143,429 filed Sep. 7, 2011, the application of which is related to and claims the priority of International Patent Application No. PCT/US2010/020412 filed Jan. 8, 2010, the application of which is related to and claims the priority of U.S. Provisional Application Ser. No. 61/143,576 filed Jan. 9, 2009, the disclosures of which are specifically incorporated by reference herein in its entirety.

FIELD OF THE INVENTION

This invention relates to earth engineering, especially relative to short aggregate column implementations. Specifically, this invention relates to a quality control apparatus and method for reducing the costs of constructing short aggregate columns and improving the construction of short aggregate columns.

BACKGROUND OF THE INVENTION

It is known to strengthen otherwise inadequate load-bearing capacity of soil by formation of short aggregate columns, such as those disclosed in U.S. Pat. No. 5,249,892, the subject matter of which is incorporated in its entirety herein by reference. Generally, short aggregate columns are constructed in situ by individually compacting a series of thin lifts or layers of aggregate within a cavity formed in the soil. When each lift is compacted, vertical compaction forces are transferred through the aggregate vertically and laterally outward to the surrounding soil. The column resulting from a vertical "stack" of lifts, each compacted before the next lift is formed and each including aggregate elements, is characterized by the ability to transfer a relatively large portion of the load outward and laterally into the adjacent, prestressed soil. Short aggregate columns have been recognized in the civil engineering field as revolutionary, partly because they provide for increased load-bearing capacity in soil environments which would otherwise tend to make construction of adequate foundations expensive or unfeasible.

Much effort has been expended towards improving short aggregate column feasibility, reducing their cost, and expanding their field of use and improving their construction. One method for forming a short aggregate column is disclosed in U.S. Pat. No. 6,354,766. The patent discloses lasers mounted on independent devices such as tripods, which become an obstruction to a tamping apparatus during construction operations, and which are used to determine the modulus of the completed pier at the end of the tamping operation at the top of the pier. One drawback of the disclosure is that the lasers do not have the ability to account for movement of a hammer system during tamping. More specifically, as the system tamps the column, the hammer and tamper shaft apply dynamic reciprocating motion to the top of the column. The laser system can measure the position of a stationary object. However, the previously disclosed system cannot be used to measure the performance of each lift of placed aggregate during the column construction process. The present invention provides several unique and novel techniques which overcome the limitations of systems such as those of U.S. Pat. No. 6,354,766, and which include novel methods and the use of a novel quality control apparatus that provide the advantages of reducing the construction cost of short aggregate columns and/or improving their construction.

Since short aggregate columns are desirable, in part, because they are economical, it is desirable to provide for construction techniques which reduce the cost of short aggregate columns compared to known construction techniques, such cost reduction being provided, for example, by monitoring column stiffness data in real time during the column construction process, rather than after the column has been completed. Additionally, it is desirable to provide methods and apparatuses for obtaining stiffness and other data from short aggregate columns during construction in order to verify that each production column built on a particular site meets required design criteria.

BRIEF SUMMARY OF THE INVENTION

In one aspect, the invention is directed to an apparatus for measuring the modulus of an aggregate column constructed through tamping the column with a vertically reciprocating driving force, where deflection at the top of the column is measured in real time to ensure each lift meets a target modulus before a new lift is added and compacted. A sensing system measures angles of various parts of a compacting machine to determine if a threshold value is reached. A filtering algorithm is applied to the angle measurements to account for vibration resulting from operation of a hammer of the compacting machine, which results in variations in angle measurement.

In another aspect, a method of constructing short aggregate columns in a soil matrix is provided. A cavity in the soil is formed and filled with successive lifts of aggregate. Tamping is initiated. Deflection of each lift is measured a plurality of times during compaction to determine the stiffness of modulus of each lift until a predetermined value is reached, and before a new lift is added.

It is desirable to measure the modulus of aggregate lifts during the column compaction process (as opposed to a single column modulus measured after the column is constructed) for the purposes of: (1) providing assurance that each compacted lift meets modulus requirements for the design and (2) enhancing the speed of compaction so that additional compaction energy is not spent after the lift has reached the threshold, or target, modulus. The present invention allows these quality control purposes to be met.

In accordance with the invention, various embodiments of a new and novel construction modulus testing apparatus and method are provided. Techniques are provided for testing characteristics, such as stiffness, of short aggregate columns. In a preferred embodiment of the invention, the vertical position of the construction tamper (or hammer) is measured and recorded during the tamping or compaction process. A measure of compacted aggregate stiffness for each aggregate lift is calculated and an electronic record of construction of the aggregate column is made.

The invention provides for verification of characteristics, such as the stiffness modulus, of short aggregate columns, in situ and during the construction process rather than after construction of the column is complete. The invention provides the ability to measure deflection of the aggregate lift over time in order to determine stiffness of each lift of the column as it is constructed. Since the stiffness is calculated during column construction, each column is verified in real time to meet design standards, thereby negating the need for any re-application of densification energy, including possible partial re-drilling and re-building of a column (as can possibly currently be done for columns of insufficient stiffness). Additionally, measurement of stiffness during construction allows the columns to be loaded at capacity as originally designed.

These and other advantages and features that characterize the invention are set forth in the claims annexed hereto and forming a further part hereof. However, for a better understanding of the invention, and of the advantages and objectives attained through its use, reference should be made to the drawings, and to the accompanying descriptive matter, in which there are described exemplary embodiments of the invention.

DETAILED DESCRIPTION OF THE INVENTION

An apparatus is disclosed for measuring the stiffness modulus over time of an aggregate column constructed by tamping the column with a vertically reciprocating driving force. The deflection at the top of the column is measured in real time during construction, and dynamic deflection measurements are processed using a computer program that filters the data to provide a smoothed modulus curve. The system includes a processing system to process data as described hereafter and a sensing system.

Figure 1A:
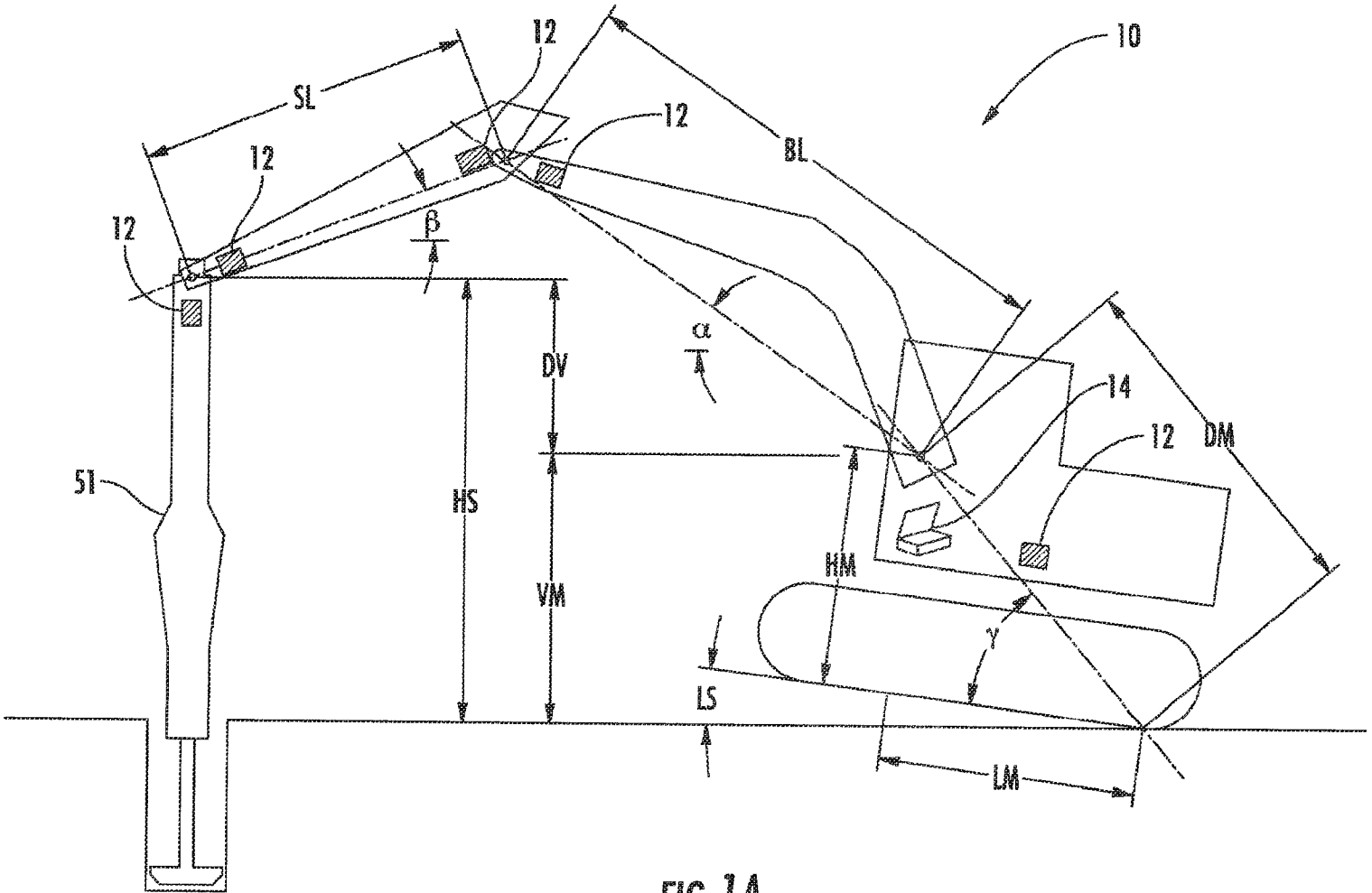
FIGS. 1*a* and 1*b* are schematic diagrams of an apparatus used in accordance with the invention, and illustrating operation of the method of the invention.

The system of the invention can use micro-electro-mechanical-systems ("MEMS") technology to determine the position of a tamper during construction. As is well known, MEMS is the integration of mechanical elements, sensors, actuators, and electronics on a silicon substrate through microfacrication. As shown in FIG. 1*a*, separately positioned sensors 12 determine the position of a tamper and its hammer 51 during construction, and show a data processor 14, having a display or other like device like a printer, located in an operator's cockpit of a tamping apparatus 10 of the invention.

While FIG. 1*a* generally illustrates exemplary positioning of sensors 12 and data processor 14, it will be appreciated that the positioning of the sensors 12 will be determined by the type of sensors system employed. Thus, for example, if a system such as that commercially available under the name Trimble GCS is employed, the manufacturer of such systems will direct the location of the sensors.

Figure 1B:
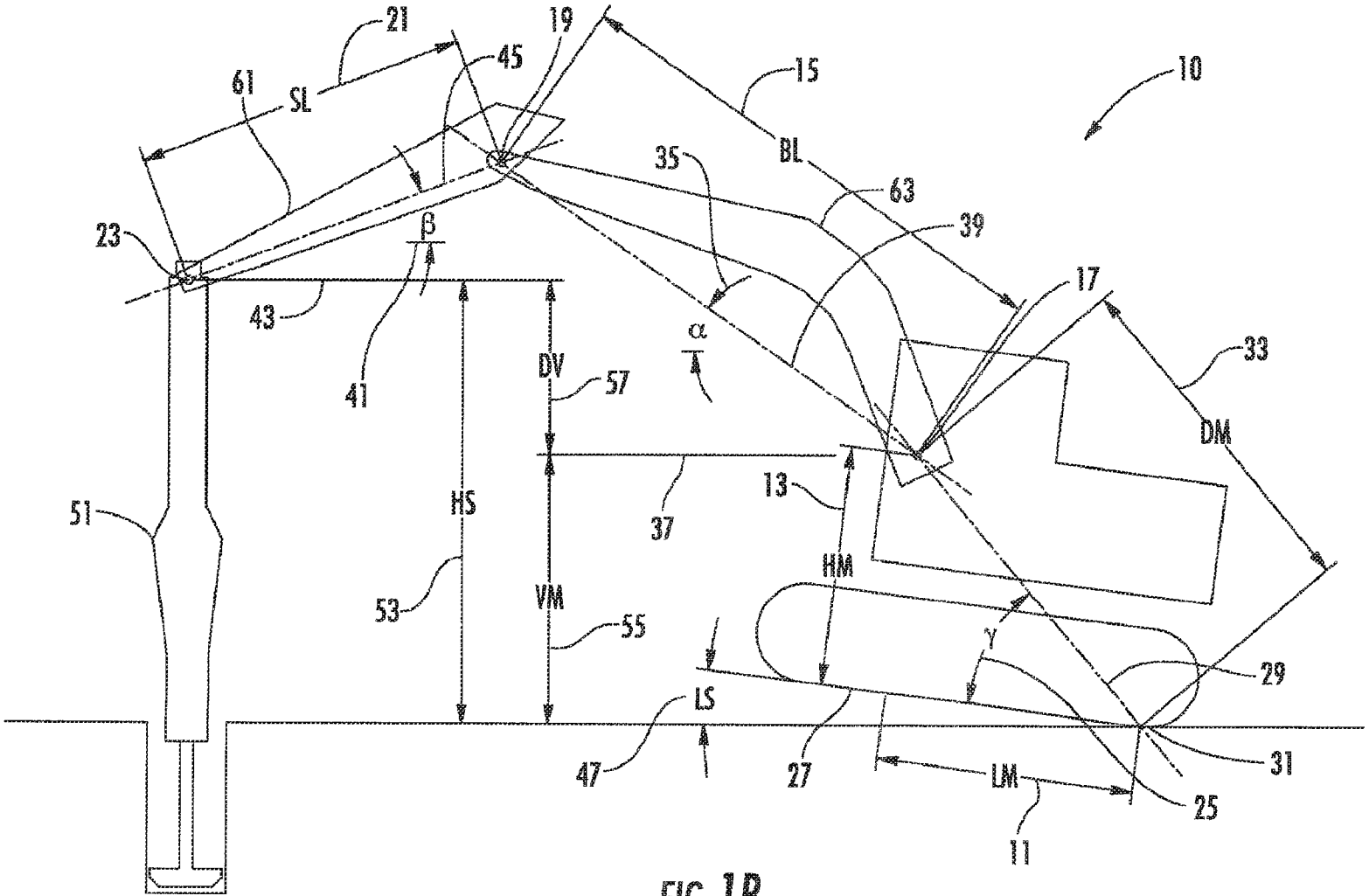
Figure 2:
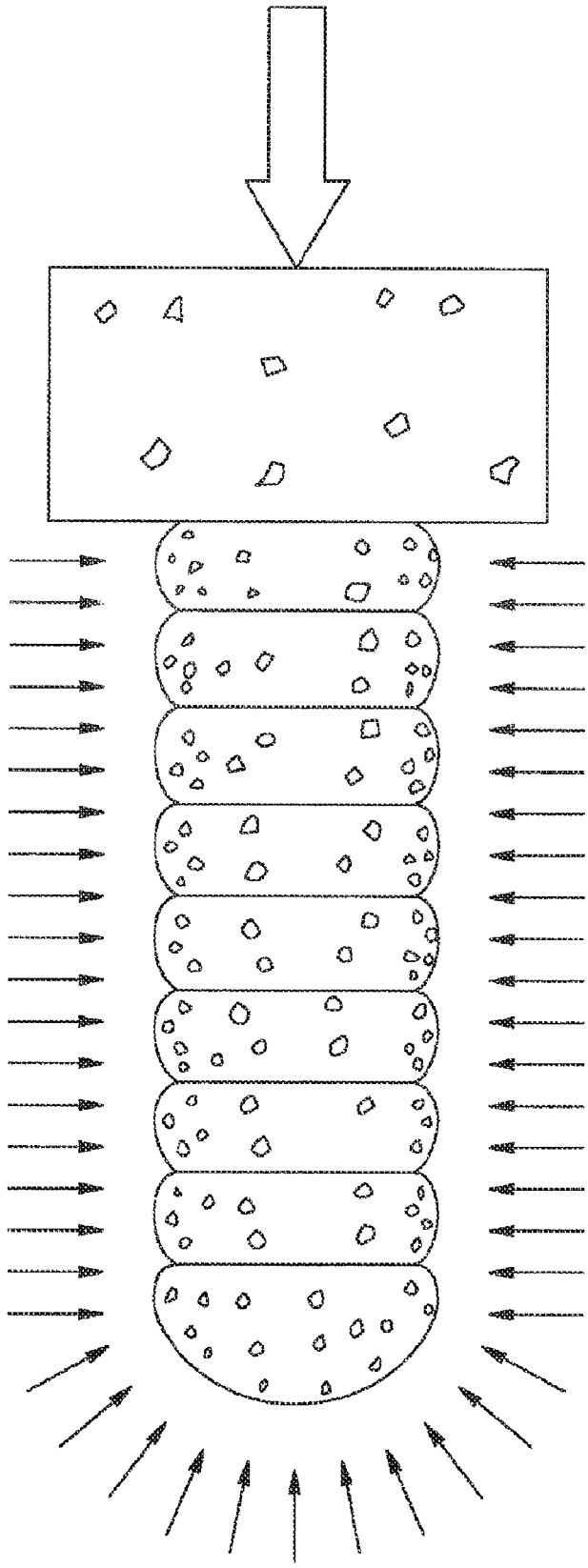
FIG. 2 is a side view of a plurality of lifts in a cavity to form a short aggregate column of the type in which the invention is employed.

In the case of the device 10 shown in FIG. 1*b*, in an exemplary embodiment, a pitch and roll sensor may be installed near the base of the boom. The sensor may be oriented with the longitudinal axis parallel to the boom centerline. A boom angle sensor may be installed on a side face of the boom 63 and oriented with the longitudinal axis parallel to line 39 from the boom/body pivot point 17 to the boom/stick pivot point 19. A stick angle sensor may be installed on a side face of stick 61 and oriented with the longitudinal axis parallel to line 45 from the boom/stick pivot 19 to the boom/hammer pivot 23.

If a system available under the name Trimble GCS600 is used, the sensors are connected to the data processor 14 in accordance with the specifications for such a system.

In accordance with FIG. 1*b*, a hammer 51 applies dynamic energy to a column being constructed. The dynamic energy results in high frequency vibration of the system during tamping. MEMS sensors which may be employed, detect the exact position of stick 61 and boom 63 of the tamping apparatus 10 at a high frequency to track dynamic response of the system, and describe the machine orientation.

As is explained hereafter with reference to the figures, the hammer 51 position is plotted over time during compaction of a single lift. Three phenomena are observed, i.e., 1) the hammer 51 moves downward during tamping, 2) there is variability in position of the hammer 51 during tamping and the variability is caused by the vibrations caused by the hammer 51 during tamping, and 3) the overall rate of downward deflection reduces with time.

A vertically reciprocating driving force is induced by a hydraulically powered tamper attached to the hammer 51 of an excavator and tamping apparatus 10 as shown in FIG. 1*b*. In an exemplary embodiment, the following dimensions of the tamping apparatus 10 components shown in FIG. 1*b*, are measured and known:

1. The length of the machine (LM) 11 is the horizontal distance from the boom/body pivot point 17 to the point of body rotation 31.
2. The height of the machine (HM) 13 is the vertical distance from the boom/body pivot point 17 to the bottom of the machine tracks (ground) 27.
3. The length of the boom (BL) 15 is the distance from the boom/body pivot point 17 to the boom/stick pivot point 19.
4. The length of the stick (SL) 21 is the distance from the boom/stick pivot point 19 to the stick/hammer pivot point 23.
5. The boom/body angle (gamma—$\gamma$) 25 is the angle formed by the bottom of the machine tracks (ground) 27 and the line 29 between the point of body rotation 31 and boom/body pivot point 17.
6. The distance of the machine (DM) 33 is the distance from the point of body rotation 31 to the boom/body pivot point 17.

The tamping apparatus 10 may use MEMS technology employed in an angle sensing system using gauges, for example, such as one commercially available under the name Trimble GCS600 system, assembled on components of the tamping apparatus 10 in a conventional manner, to measure machine orientation angles in real time. The angles are measured relative to the horizon with respect to tamping apparatus 10 in which the following measurements are used:

1. The boom angle (alpha—$\alpha$) 35 is the angle between the horizon line 37 and the line 39 between the boom/body pivot point 17 and the boom/stick pivot point 19.
2. The stick angle (beta—$\beta$) 41 is the angle between the second horizon line 43 and the line 45 between the boom/stick pivot point 19 and the stick/hammer pivot point 23.
3. The longitudinal slope (LS) 47 is the angle between the horizon and the longitudinal axis of the machine body.

4. The cross slope (CS) is the angle between the horizon and the transverse axis of the tamping apparatus 10 body (not shown in FIG. 1*b*).

Vibrations resulting from the operation of the hammer 51 of the tamping apparatus 10 for compaction influence the sensors on the tamping apparatus 10 which are used to measure the angles, and result in variations in angle measurements. The angle measurements are processed to account for this induced variation by applying a filtering algorithm to produce filtered angle measurements. The filter can use a Parks-McClellan equiripple algorithm that makes use of the Remez Exchange algorithm to produce an optimal linear phase filter approximating a desired frequency response, in a manner apparent to those of ordinary skill based on the disclosure herein. Smooth deflection plots are generated as disclosed herein through the algorithm which allows for interpretation of the data. The filter is generated using the REMEZ (N,F,A,W) command in Matlab, wherein:

N+1=number of filter taps.

F=frequency band edges as fractions of the Nyquist frequency.

A=desired frequency response values at the band edges.

W=weights to be applied to the pass and stop bands.

Figure 3:
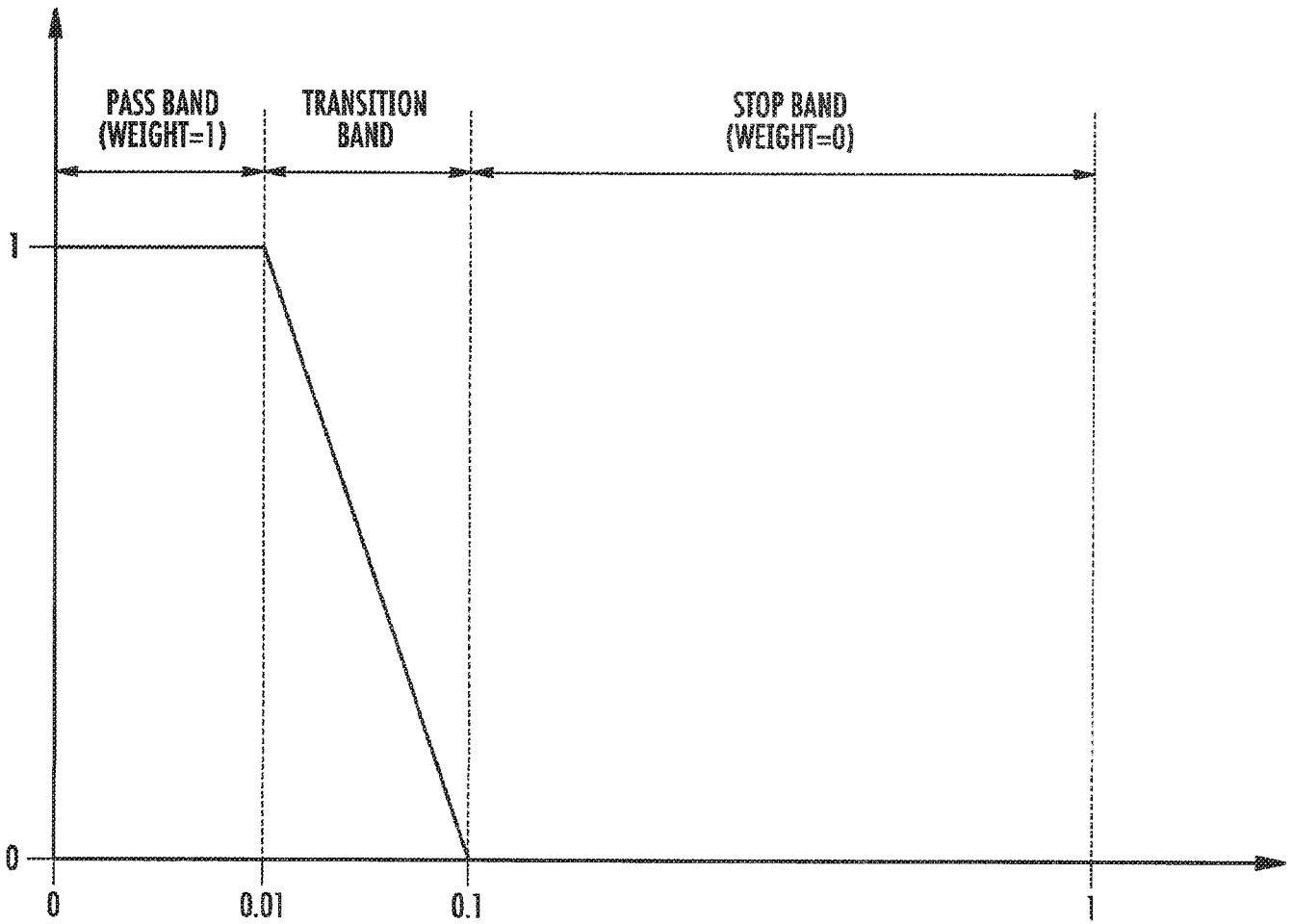
FIG. 3 is a graph showing how a filtering algorithm is applied.

In an exemplary embodiment, the filter employed is a 35 point filter generated by:

REMEZ(34, [0 0.01 0.1 1], [1 1 0 0], [1.3]), as is illustrated in FIG. 3.

The resulting filter is scaled so that the direct current ("DC") response is exactly 1 by:

$$h=h/\mathrm{sum}(h)$$

and the scaled filter weights are:

1. 0.007125044906646
2. 0.005943054100178
3. 0.008199587605973
4. 0.010822522399877
5. 0.013794983660447
6. 0.017073009490180
7. 0.020603266578722
8. 0.024304546620220
9. 0.028097813618765
10. 0.031881797182137
11. 0.035555749201273
12. 0.039019795063257
13. 0.042150954045455
14. 0.044871906212448
15. 0.047082607397000
16. 0.048719345391338
17. 0.049721660761634
18. 0.050064711528905
19. 0.049721660761634
20. 0.048719345391338
21. 0.047082607397000
22. 0.044871906212448
23. 0.042150954045455
24. 0.039019795063257
25. 0.035555749201273
26. 0.031881797182137
27. 0.028097813618765
28. 0.024304546620220
29. 0.020603266578722
30. 0.017073009490180
31. 0.013794983660447
32. 0.010822522399877
33. 0.008199587605973
34. 0.005943054100178
35. 0.007125044906646

Figure 4:
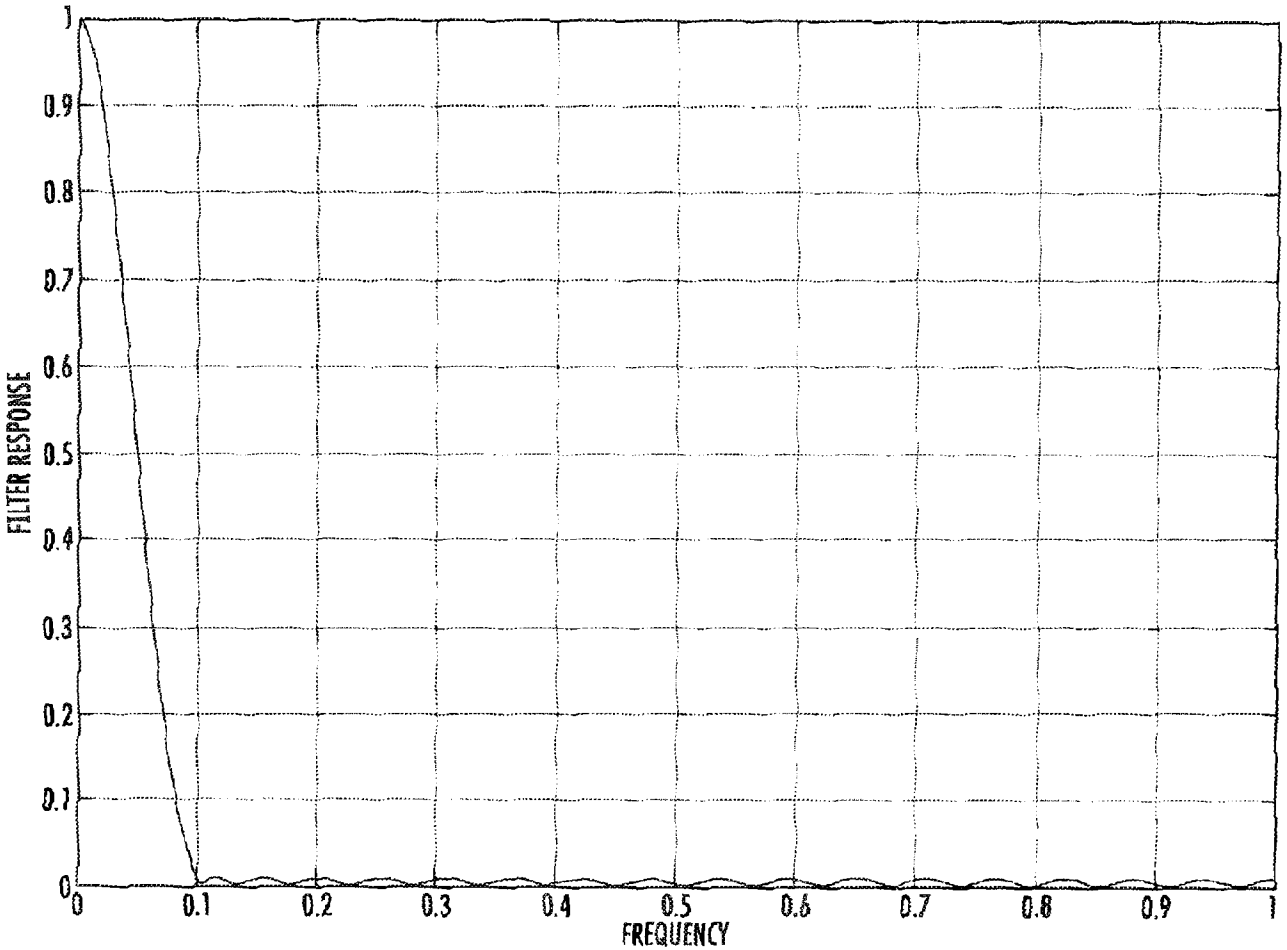
FIG. 4 illustrates the filter response on a linear scale.
Figure 5:
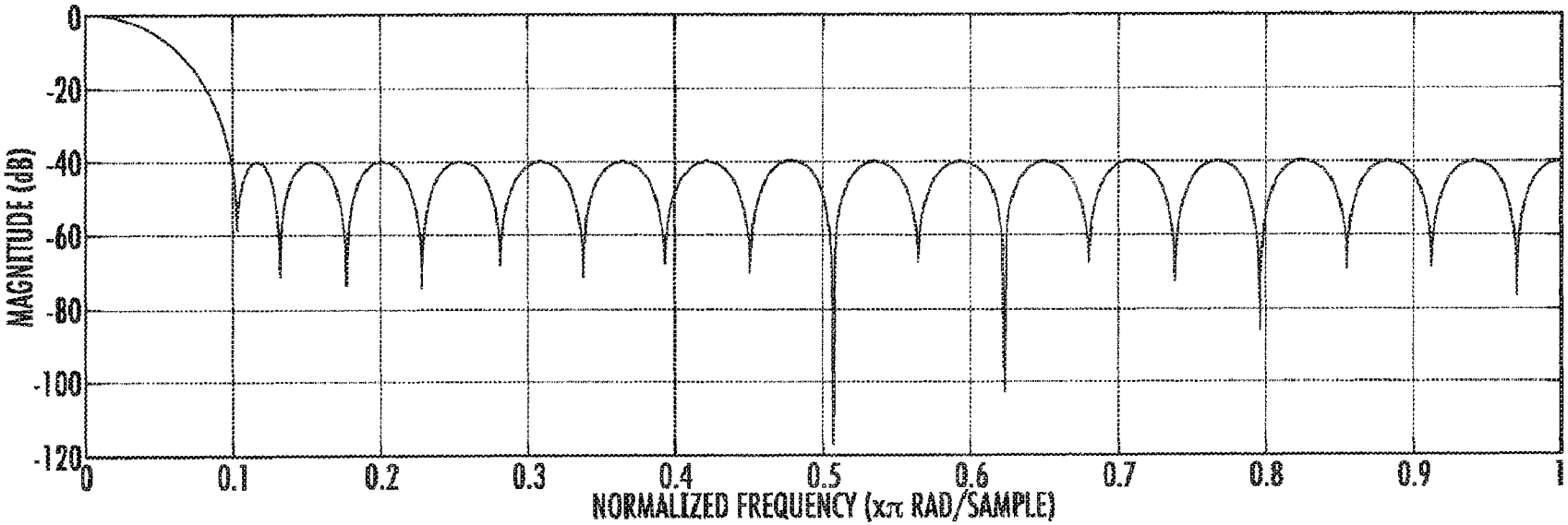
FIG. 5 illustrates the filter response on a logarithmic scale.

The filter response is plotted on a linear scale in FIG. 4 and on a logarithmic scale in FIG. 5.

Figure 6:
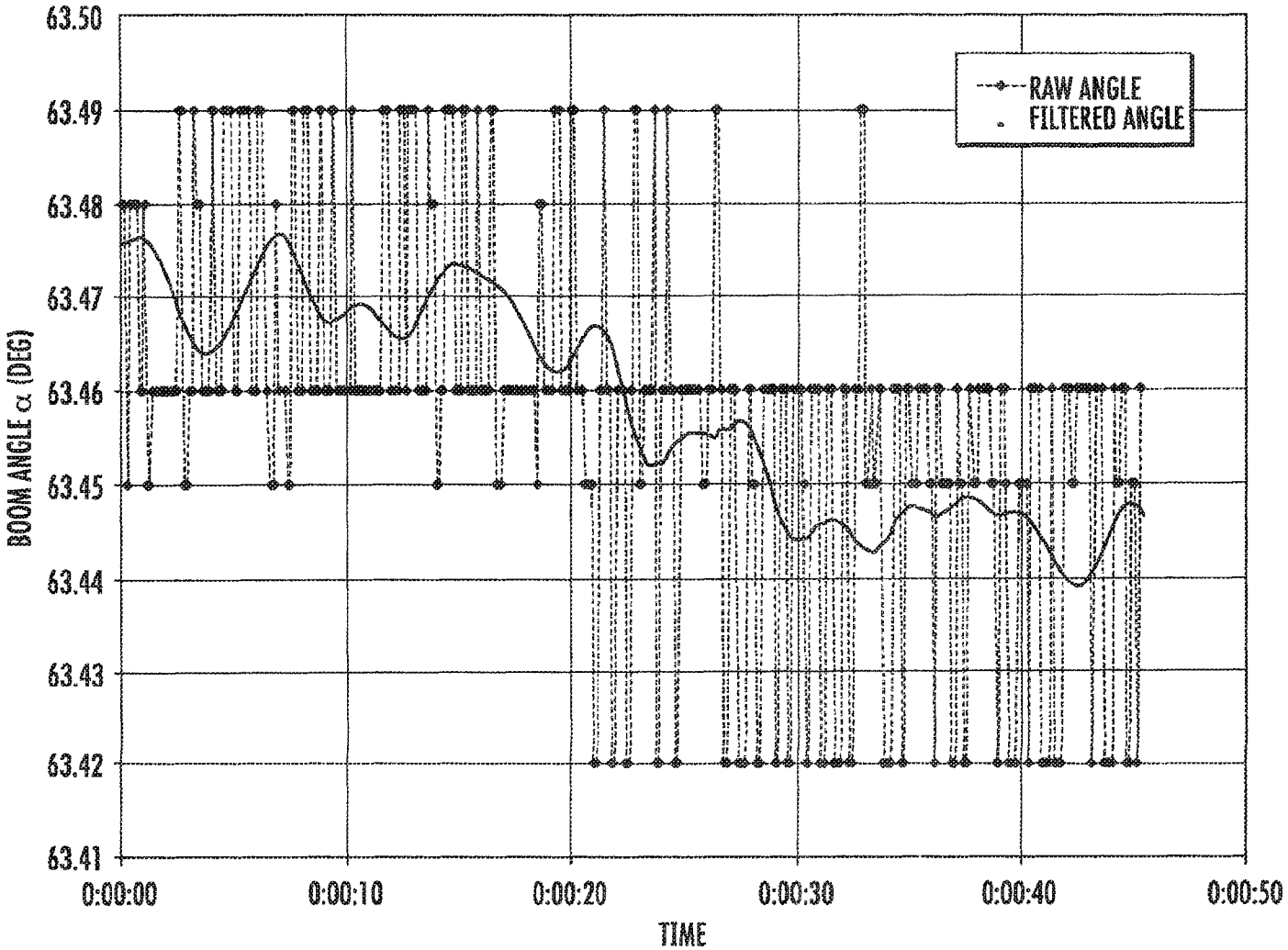
FIG. 6 illustrates raw and filtered angle data obtained with the invention for the boom angle.
Figure 7:
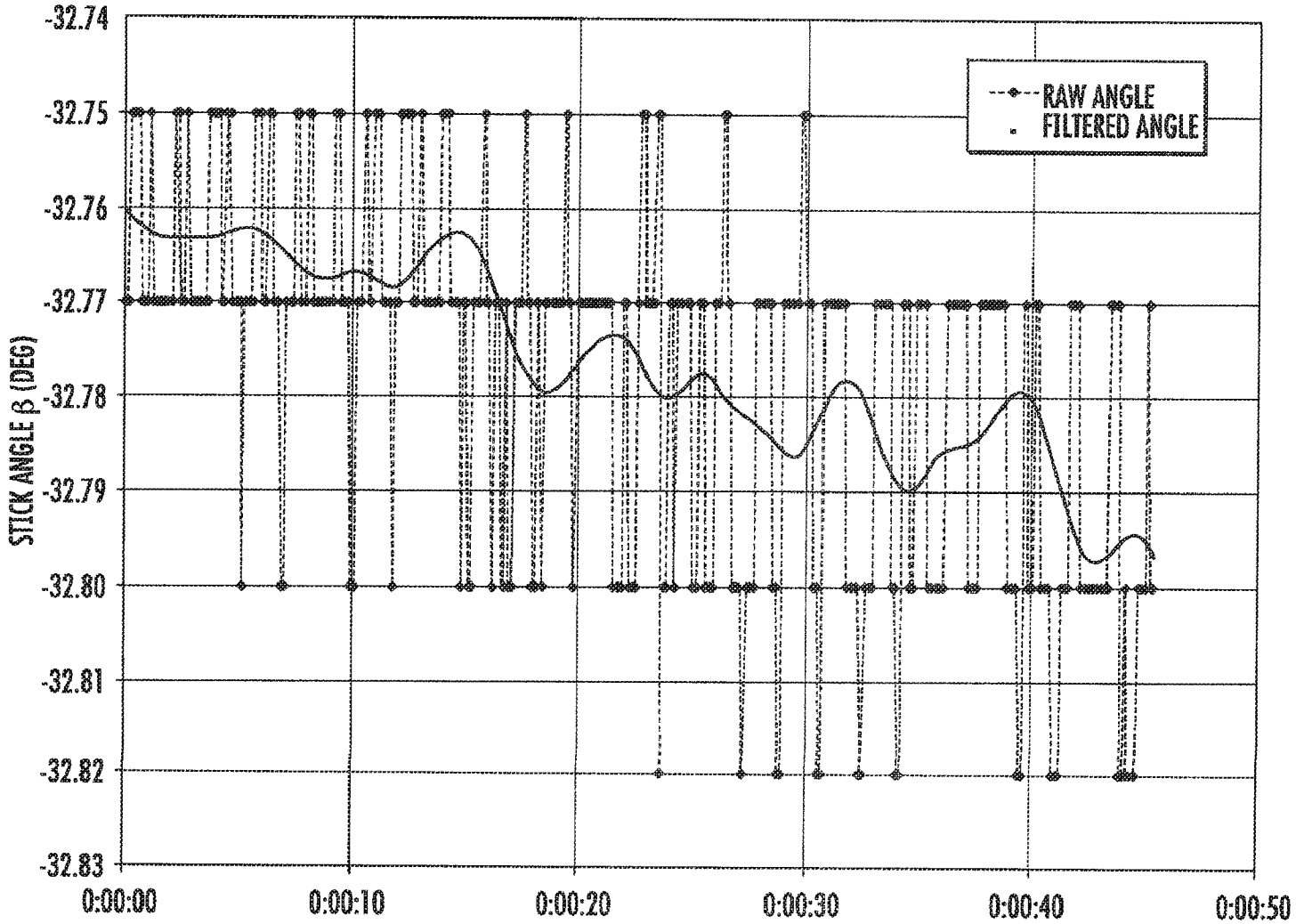
FIG. 7 illustrates raw and filtered angle data obtained for the stick or hammer angle.

As also shown in the figures, examples of the raw angles and the filtered response angles are shown in FIGS. 6 and 7 for boom angle alpha and stick angle beta, respectively.

The filtered response of the four measured angles (α, β, CS, and LS) and the known machine dimensions are used in real time to calculate the height of the stick/hammer pivot point (HS) 53. As shown in FIG. 1*b*, the value of HS 53 at any point in time is the sum of the height of the machine (VM) 55 and the vertical distance (DV) 57 between the boom/body pivot point 17 and the stick/hammer pivot point 23.

Referring to FIG. 1*b*, the following calculations apply:

$$VM=\sqrt{LM^2+HM^2}*\sin(LS+\gamma)$$

$$DV=(BL*\sin\alpha+SL*\sin/\beta)*\cos CS$$

$$HS=VM+DV$$

Figure 8:
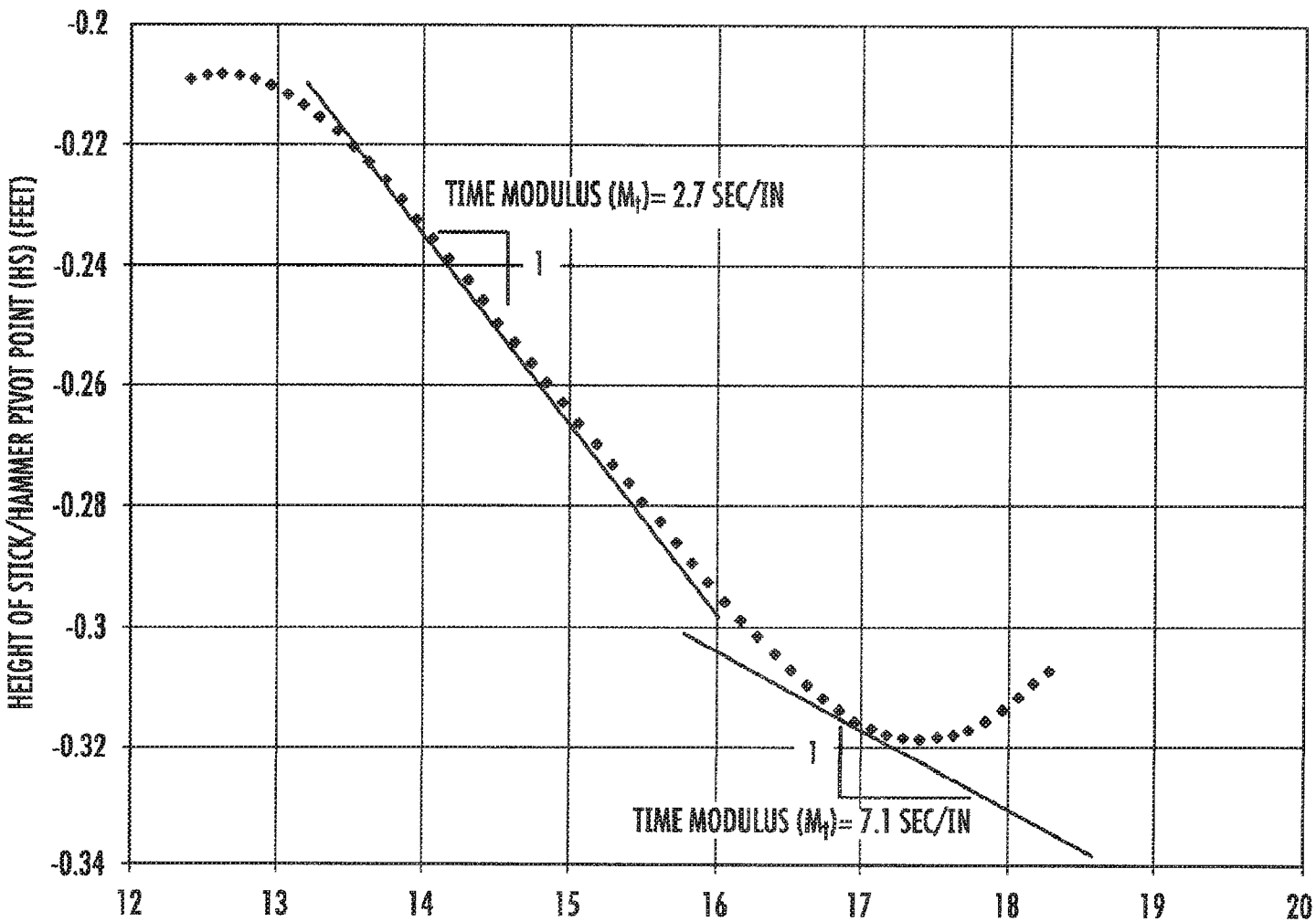
FIG. 8 illustrates results of calculation of time modulus in accordance with the invention.

At the start of the column lift compaction process, the apparatus 10 includes a system that measures the angles at the aforedescribed locations, determines the filtered response of each angle, and calculates the initial height of stick ($HS_0$). During the compaction process, the apparatus calculates the height of the stick at time t ($HS_t$), preferably, approximately nine times per second. The calculated $HS_t$ is further filtered based on a 27 point moving average and used to calculate the time modulus ($M_t$), as shown in FIG. 8. The time modulus is inverse of the slope of the filtered HS versus time curve.

Figure 9:
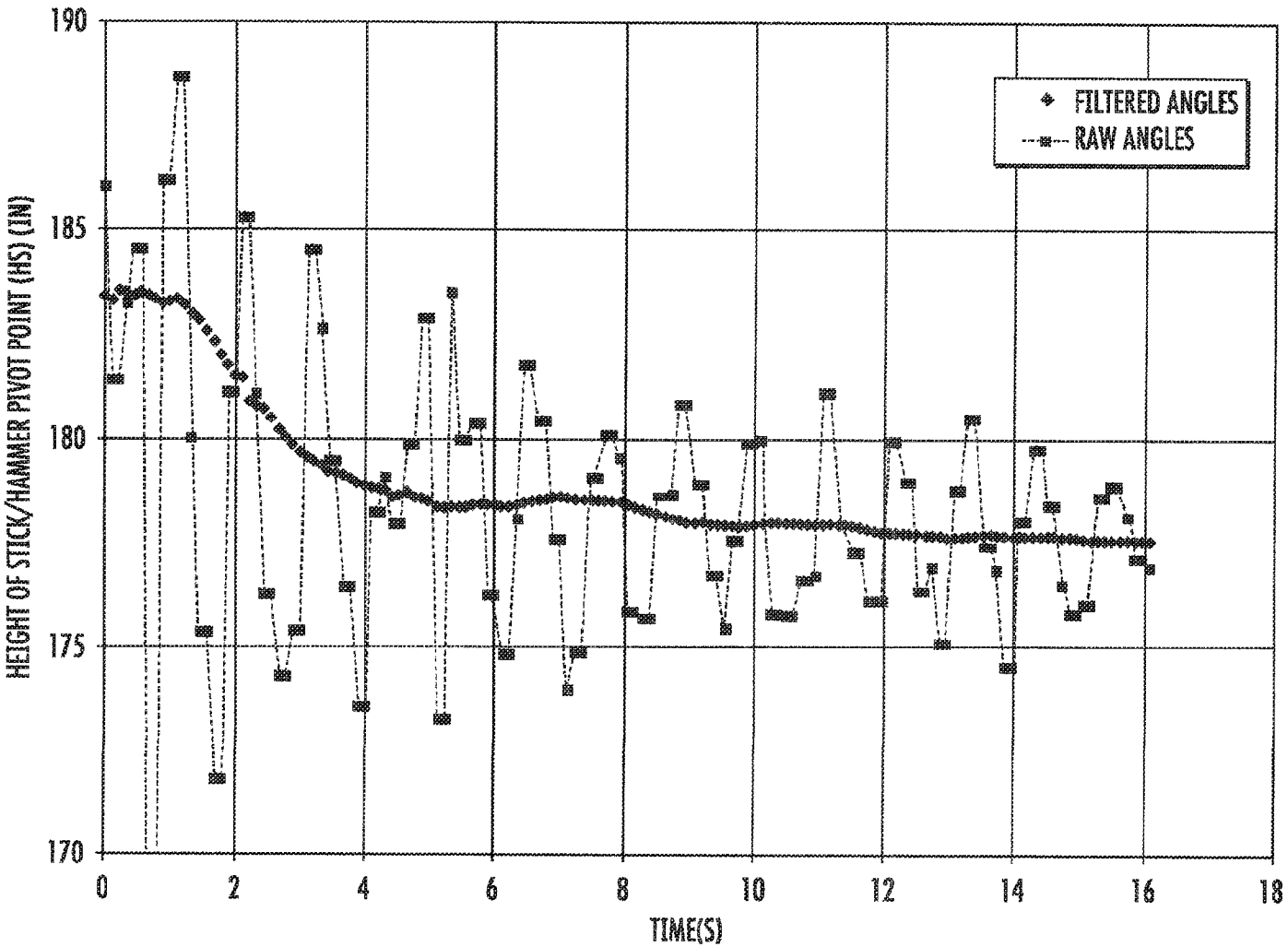
FIG. 9 illustrates the effect of filtering the angle measurements on calculated HS values.
Figure 10:
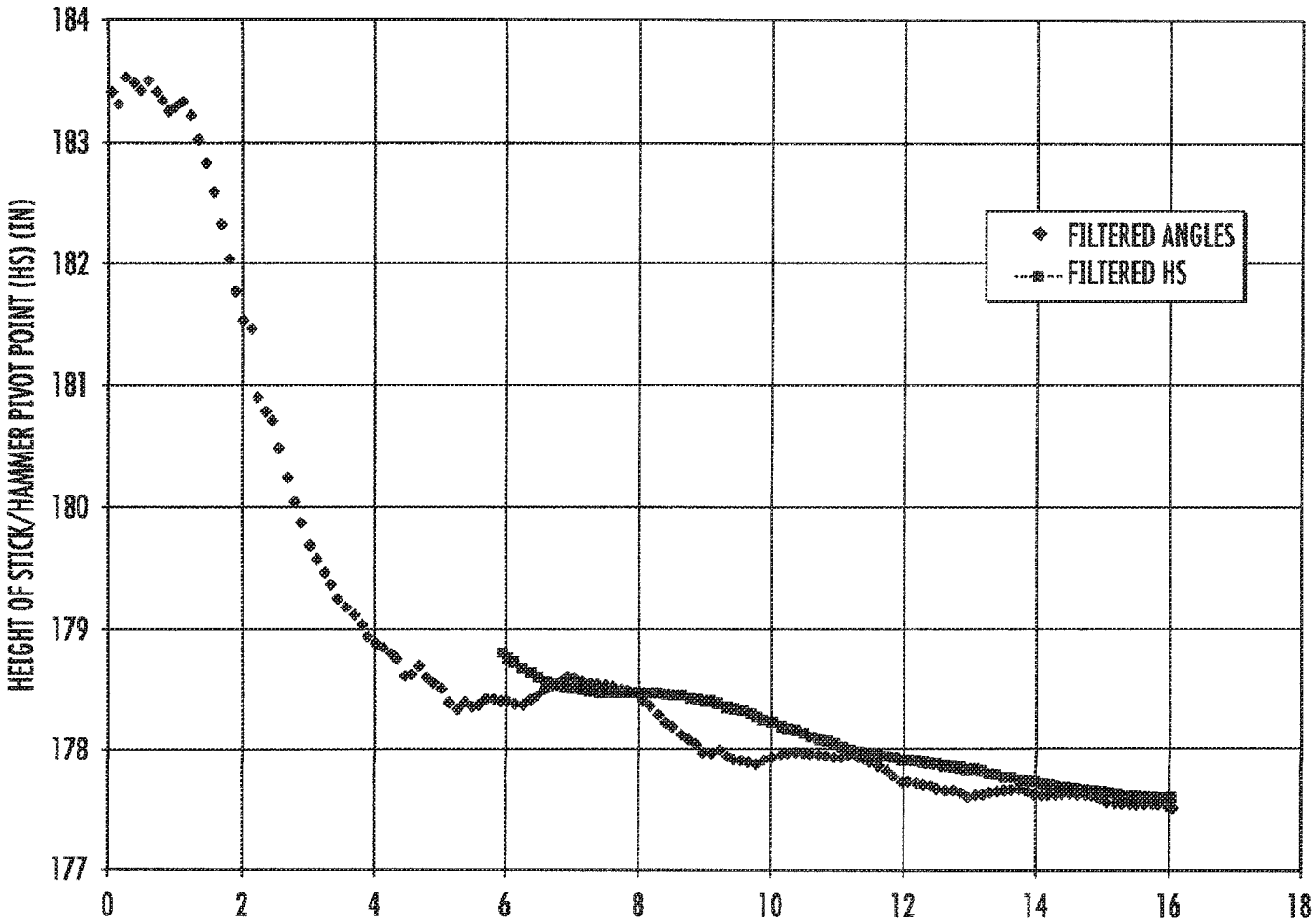
FIG. 10 illustrates the effect of filtering the HS values.

The effect of the data filters is to reduce the variability of the calculated $HS_t$ values sufficiently to provide calculated $M_t$ values that are meaningful. FIG. 9 shows the effect of filtering the angle measurements on the calculated HS values, while the effect of filtering the HS values is shown in FIG. 10.

Figure 11:
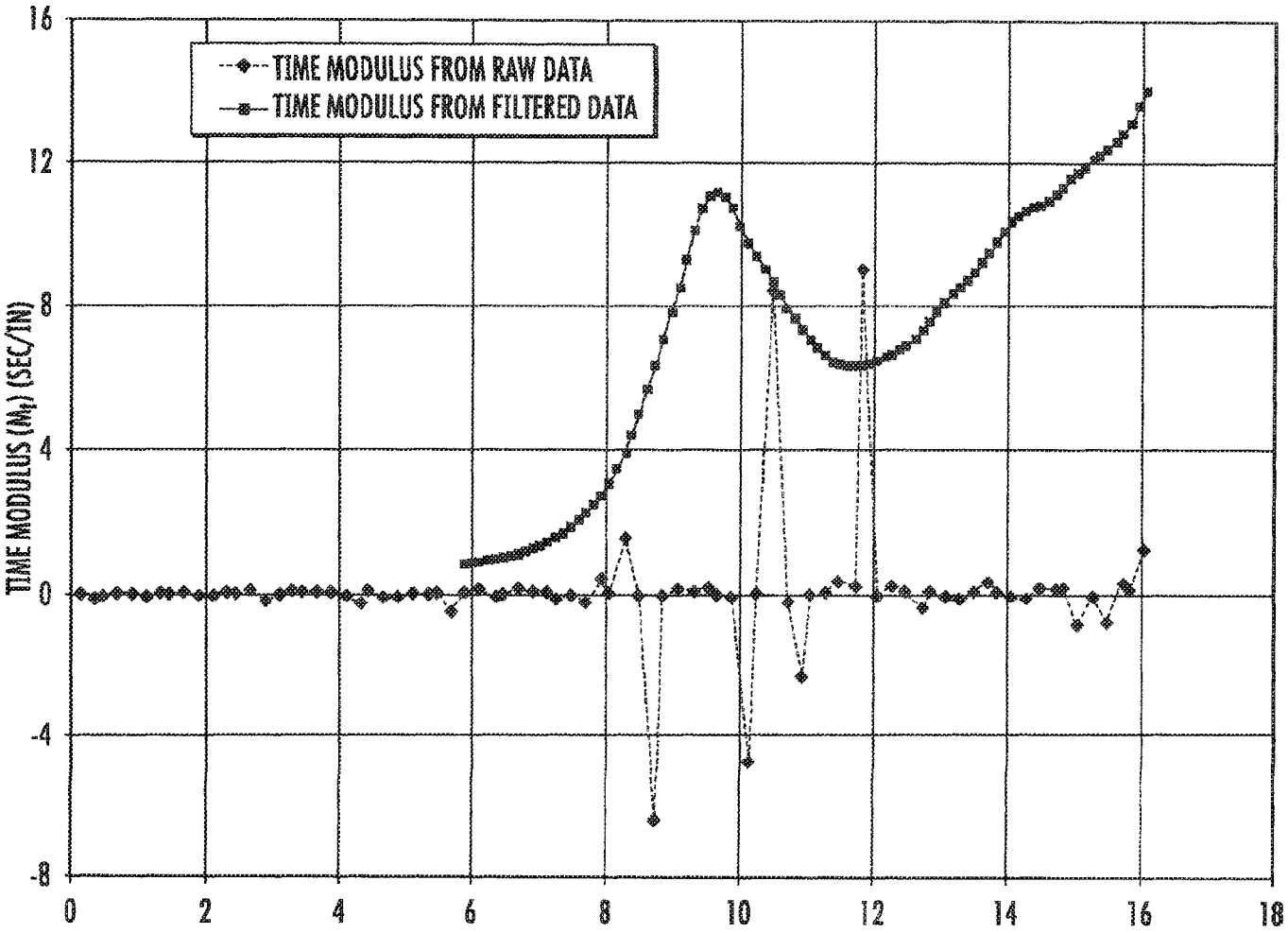
FIG. 11 illustrates the effect of filtering on calculated time modulus values.

The effect of the data filters on the calculated $M_t$ values is shown in FIG. 11. The HS versus time curve is highly variable when HS is calculated using the raw angle measurements, referencing FIG. 9, and the magnitude of the slope of the curve is large. The time modulus ($M_t$) is the inverse of the slope of the HS versus time curve, and thus the values of $M_t$ calculated when no filtering is applied are consistently small and difficult to interpret. Values of $M_t$ calculated using filtered angles and filtered HS values represent the underlying phenomenon and is therefore meaningful as a real-time measure of column lift stiffness. Accordingly, once deflection is reduced to a predetermined amount (a smaller amount) as determined from the calculations, compaction can cease and a new lift added as appropriate.

Referring to the prior description, the use of commercially available systems for excavators such as the Trimble GCS 600 system for measuring elevation is possible. In addition, other components which can be used include, for example, one available under the name, Panasonic Toughbook U1 PC, and customized data filtering and recording software as is evident to those of ordinary skill from the prior description.

As will be appreciated, in practice, the invention involves the measurement of angles of the tamping apparatus stick and boom 61 and 63, and resolving of the respective angles to obtain the tamper elevation. Elevation is typically measured approximately ten (10) times per second and recorded in a raw data form. The software algorithm previously described is used to filter the data (that accounts or corrects for tamper vibration, etc.) as shown in the attached figures. The generated curves are analogous to stiffness of the lift and when the slope of the curves reach a certain pre-defined angled, it is determined that the target modulus has been reached. For example, as shown in FIG. 8, the time modulus at a tamping time at 14 seconds is 2.7 seconds/inch. At a tamping time of 17 seconds, the time modulus value increases to 7.1 seconds/inch. If the target threshold time modulus of 7 seconds/inch is established for the design, the lift would need to be tamped approximately 17 seconds to reach the modulus criterion.

In various operating and project site environments, the typical process will involve the testing of a load column to get the target base point for that particular site. This site specific data is then used on production columns throughout the construction process. The modulus testing process is performed during construction of each lift and provides the quality control necessary to confirm that each column meets design standards.

The invention also includes the use of standardized data recording hardware, and a pressure switch on a hydraulic line, to start/stop the data recording, identification of a lift quality metric, providing a hammer operating status indicator, and the use of a hammer plumbness sensor. A pier quality metric may also be identified from a combination of each lift quality metric.

The foregoing detailed description of embodiments refers to the accompanying drawings, which illustrate specific embodiments of the invention. Other embodiments having different structures and operations do not depart from the scope of the present invention. The term "the invention" or the like is used with reference to certain specific examples of the many alternative aspects or embodiments of the applicants' invention set forth in this specification, and neither its use nor its absence is intended to limit the scope of the applicants' invention or the scope of the claims. This specification is divided into sections for the convenience of the reader only. Headings should not be construed as limiting of the scope of the invention. It will be understood that various details of the present invention may be changed without departing from the scope of the present invention. Furthermore, the foregoing description is for the purpose of illustration only, and not for the purpose of limitation.

What is claimed is:

1. An apparatus for measuring a modulus of an aggregate column from tamping of lifts during construction of the column, the apparatus comprising:

(a) a tamper head operable for vertically tamping lifts inserted into a cavity for constructing the aggregate column;

(b) a sensing system for detecting in real time any deflection of a lift on a top of the aggregate column being built during tamping operations, from deflections of the tamper head during tamping; and (c) a processing system for conducting calculations from the detected deflections to produce an output, and configured to show in the output when the column has achieved a desired modulus for the column.

2. The apparatus of claim 1, wherein, when the column has achieved the desired modulus for the column, tamping can be stopped and a new lift added for continuing construction of the aggregate column, and repeated until the column is completed.

3. The apparatus of claim 2, further comprising said boom arm connected to a stick which is connected to the tamper hammer, and said boom arm and stick controlled by an excavation and tamping apparatus.

4. The apparatus of claim 1, wherein the tamper head is connected to a tamper hammer which is connected to a boom arm, and the sensing system is configured for detecting relative angles between connections between the tamper hammer and the boom arm.

5. The apparatus of claim 1, wherein the processing system is configured for filtering vibrations caused by tamping for the detected deflections.

6. The apparatus of claim 5, wherein the processing system is configured for filtering the detected deflection using a Parks-McClellan equiripple algorithm.

7. The apparatus of claim 1, wherein the processing system is configured for producing a visual output.

8. The apparatus of claim 7, wherein the visual output comprises a graphical output.

9. The apparatus of claim 8, wherein the graphical output comprises a smoothed graphical output.

10. The apparatus of claim 8, wherein the graphical output comprises a graphical output in curve form.

11. The apparatus of claim 7, wherein the visual output comprises a numerical output.

12. The apparatus of claim 1, wherein the processing system is configured to provide the output as an indication of the amount of deflection or the elevation of the tamper head over time.

13. The apparatus of claim 1, further comprising a hammer connected to the tamper head, and a boom and stick connected to the hammer, and the sensing system connected for detecting relative angles between the boom, stick and hammer for processing by the processing system to determine tamper head deflection.

14. The apparatus of claim 13, further comprising the processing system adapted for filtering deflection detected and for removing the effects of vibrations attributable to tamping.

15. The apparatus of claim 14, wherein the processing system is configured for producing an output indicative of lift deflection during tamping.

16. The apparatus of claim 15, wherein the output comprises a smoothed graphical output.

17. A method of constructing a short aggregate column in a soil matrix, the method comprising the steps of:

(a) forming a cavity in the soil matrix by withdrawing material from the soil matrix to form the cavity;

(b) at least partially filling the cavity with successive lifts of aggregate, compacting at least some of the lifts in serial order as the lift is filled into the cavity to thereby form the short aggregate column in the cavity which is comprised of multiple lifts, at least some of which are compacted subsequent to their placement in the cavity, and prior to placement of further lifts thereon; and (c) measuring deflection of each lift during a lift compaction, and producing an output configured to show when the column has achieved a desired modulus for the column.

18. The method of claim 17, wherein the compaction is conducted with a device having a tamper hammer with a tamper head at a tamping end thereof, and a boom connected to a stick, connected to the tamper hammer; and further comprising measuring an angle between the boom, the stick and the tamper hammer to determine the deflection of each lift during tamping.

19. The method of claim 18, wherein the measuring of the angle is used to calculate the deflection of the tamper head during tamping.

20. The method of claim 18, wherein the measuring of the angle is filtered to eliminate effects of tamping vibrations from the tamping.

21. The method of claim 20, wherein the filtering is conducted with a processing system applying a Parks-McClellan equiripple algorithm to generate an output representative of lift deflection.

22. The method of claim 21, wherein the output comprises a smooth graphical output.

23. The method of claim 22, wherein the output is determined by plotting the measured deflection in relation to time to determine time modulus of the lift.

24. The method of claim 23, wherein tamping for a specific lift is terminated when a desired amount of deflection is achieved, or until a minimum time modulus value is reached.

25. The method of claim 24, further comprising adding a new lift and commencing tamping for the new lift when the tamping for a specific lift is terminated.

26. The method of claim 17, wherein the measurements are conducted a plurality of times during tamping.

27. The method of claim 17, wherein the initial height of a tamper hammer and the amount of deflection of the tamper hammer are determined over a period of time to result in an output indicative of tamper hammer deflection at specific points in time over a period of time during tamping operations.

28. The method of claim 27, wherein the output comprises a graphical output.

29. The method of claim 17, wherein the tamping is conducted with a tamper hammer connected to at least one boom arm, and wherein the deflection of each lift is determined from detection of each angle between the tamper hammer, the stick and the boom arm during tamping.

* * * * *